US011064285B1

(12) United States Patent
Downs, Jr.

(10) Patent No.: US 11,064,285 B1
(45) Date of Patent: Jul. 13, 2021

(54) TUNABLE CONTACT MICROPHONE

(71) Applicant: United States of America as represented by the Secretary of the Navy, Arlington, VA (US)

(72) Inventor: Edward Downs, Jr., Lynn Haven, FL (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 317 days.

(21) Appl. No.: 16/399,131

(22) Filed: Apr. 30, 2019

(51) Int. Cl.

| | |
|---|---|
| ***H04R 1/00*** | (2006.01) |
| ***H04R 1/22*** | (2006.01) |
| ***H04R 1/14*** | (2006.01) |
| ***H04R 17/02*** | (2006.01) |
| ***H04R 1/08*** | (2006.01) |

(52) U.S. Cl.
CPC ..... *H04R 1/222* (2013.01); *H04R 1/08* (2013.01); *H04R 1/14* (2013.01); *H04R 17/02* (2013.01)

(58) Field of Classification Search
CPC ... H04R 1/14; H04R 1/08; H04R 1/46; H04R 1/222; H04R 17/02
See application file for complete search history.

(56) References Cited

U.S. PATENT DOCUMENTS 6,586,095 B2 * 7/2003 Wang ..... B82Y 30/00 428/220
7,644,622 B2 * 1/2010 Qiao ..... G01L 9/0019 73/723
9,453,774 B2 * 9/2016 Bao ..... G01L 7/041
9,511,224 B1 * 12/2016 Downs, Jr. ..... H01L 41/113
9,789,311 B1 * 10/2017 Downs, Jr. ..... A61N 1/36036
10,112,046 B1 * 10/2018 Downs, Jr. ..... A61N 1/0541
10,722,174 B2 * 7/2020 Pang ..... A61B 5/0002
2005/0064731 A1 * 3/2005 Park ..... H01L 41/18 438/800
2007/0225776 A1 * 9/2007 Fritsch ..... A61N 1/36038 607/57
2008/0129278 A1 * 6/2008 Dai ..... G01D 5/142 324/109

(Continued)

OTHER PUBLICATIONS

Kang et al, Transparent and conductive nanomembranes with orthogonal silver nanowire arrays for skin-attachable loudspeakers and microphones, Science Advances, Aug. 2018 (Year: 2018).*

*Primary Examiner* — Matthew A Eason
(74) *Attorney, Agent, or Firm* — James T. Shepherd

(57) ABSTRACT

A tunable contact microphone is fabricated from nanometer size piezoelectric materials. The piezoelectric nanostructures are deposited on a flexible substrate or tunable resonant backplane. The backplane can be designed to vibrate at fundamental harmonic or sub-harmonic frequencies from 10 Hz to 20 KHz, corresponding to vibration frequencies of the human cranium. The backplane can be attached to a band or other material that will facilitate the attachment to the forehead, behind the ear or throat, with a preferred location being the forehead. When a person speaks, the backplane vibrates causing the nanostructures to generate electricity. The electrical signals are sent to an impedance matching preamplifier. The signal can then be sent to a communications system or fed into the microphone input of a communication system.

18 Claims, 2 Drawing Sheets

(56) References Cited

U.S. PATENT DOCUMENTS

| | | | | |
|---|---|---|---|---|
| 2008/0264185 | A1* | 10/2008 | Kobayashi | G01L 1/044 73/862.637 |
| 2008/0314149 | A1* | 12/2008 | Rueger | H03H 3/0077 73/579 |
| 2010/0056851 | A1* | 3/2010 | Wang | H04R 17/02 600/25 |
| 2014/0100415 | A1* | 4/2014 | Hellmuth | H04R 25/606 600/25 |
| 2020/0008299 | A1* | 1/2020 | Tran | A61B 5/686 |

* cited by examiner

TUNABLE CONTACT MICROPHONE

STATEMENT OF GOVERNMENT INTEREST

The invention described herein may be manufactured and used by or for the Government of the United States of America for governmental purposes without the payment of any royalties.

BACKGROUND OF THE INVENTION

(1) Field of the Invention

The present invention relates to contact microphones. More particularly, the present invention relates to contact microphones made from nanometer size piezoelectric materials or nanotubes, microfibers, nanowires, and carbon nanotubes (CNT) doped with piezoelectric materials.

(2) Description of the Prior Art

Current air and contact microphone elements can be manufactured from piezoelectric materials such as a ceramic disk or polyvinylidene fluoride (PVDF) film. When a ceramic disk is used, it generally has a round shape, which is glued to a thin metal substrate. The most common substrate is brass. The center of the disc is positive while the brass substrate is negative. In a PVDF contact microphone, the PVDF film is mounted to a metal, plastic or polymer substrate, or is stretched over the open end of a cylinder so the material can vibrate freely.

Generally, bone conduction microphones are mounted on the head, behind the ear, or on the throat, and are used in communication systems for the transmission of speech. When a person speaks, the skull vibrates in accordance with the sounds that are produced by the person's vocal cords. Bone conduction microphones detect vibrations in the user's cranium or throat and convert the vibrations into electrical signals that are fed into a two-way radio. However, conventional bone conduction microphones are made of piezoelectric materials having a fixed frequency response, which cannot be easily modified. In consequence, these existing contact microphones not only detect voice but also detect background noise.

Thus, a need exists for a contact microphone that provides a significant improvement in signal to noise resulting is a crisper voice signal. The contact microphone should be able to be tuned to resonate at the vibration frequencies of the human cranium, thus ameliorating the detection of background noise. Additionally, the tunable contact microphone should provide for noise cancellation to further improve the voice signal. Compatibility with existing cell phone use should also be incorporated into the tunable contact microphone.

SUMMARY OF THE INVENTION

It is therefore an object of this present invention to provide a tunable head contact microphone. The tunable microphone will be fabricated from nanometer size piezoelectric materials and may also be fabricated from nanotubes, microfibers, nanowires, or carbon nanotubes (CNT) doped with piezoelectric materials. The nanometer size piezoelectric materials and each of the doped microfibers, tubes or wires produce electricity when stimulated by pressure or vibration.

The nanostructures are arranged so that the electrical signal they produce is funneled into electrical conductors. The conductors will carry the electrical signal to an impedance matching preamplifier. After the preamplifier, the signal can be sent to a communications system or fed into the microphone input of a two-way radio.

The piezoelectric nanoparticles, doped CNT, or piezoelectric nanowires become contact microphones when they are deposited on a flexible substrate or tuned resonant backplane. The resonant backplane resonates like the skin of a drum and can be designed to vibrate at fundamental harmonic or sub-harmonic frequencies from 10 Hz to 20 KHz, corresponding to vibration frequencies of the human cranium.

The backplane can be attached to a band or other material that will facilitate attachment to the forehead, behind the ear, or throat, with a preferred location being the forehead. This will allow the backplane to detect the voice vibrations when a person speaks. When the backplane vibrates, the piezoelectric nanostructures generate electrical signals that are fed to a communications system.

The tunable contact microphone can be combined with a second microphone placed a short distance away, which is able to detect background noise vibrations, but no voice vibrations. The outputs from the two microphones can be fed into a differential amplifier, which subtracts the noise signal from the tunable head contact microphone signal. The result is a voice signal with little or no background noise.

The tunable contact microphone can also be used in conjunction with cell phone usage. The microphone can be molded into a clip holding the phone earbuds to a user's ear. The clip will be in contact with the user's head either in front or behind the ear. The electrical voice signals from the microphone can be transmitted to the phone's voice input.

Additionally, the microphone can be molded into the edge of a cell phone. When using the cell phone, the user can place the upper portion of the phone in contact with the head. The vibration of the head stimulates the nanowires to generate electrical signals, which are transmitted to the voice input of the cell phone. This design can be used instead of the standard cell phone microphone in noisy environments, as the standard microphone can pick up background noise.

In one embodiment, a tunable contact microphone includes a flexible backplane having resonant frequencies corresponding to the vibrations of the human cranium and piezoelectric nanostructures affixed on the backplane. The piezoelectric nanostructures generate electrical signals in response to the resonance of the backplane. The contact microphone also includes a conductive electrical bus connected to the piezoelectric nanostructures, which collects the electrical signals, and an impedance matching junction field effect transistor connected between the conductive electrical bus and a voice input of a communications system.

The piezoelectric nanostructures can include piezoelectric materials doped onto nanotubes, microfibers, nanowires or carbon nanotubes. The piezoelectric nanostructures may also be nanometer size piezoelectric materials grown on the backplane, which may be of varying lengths.

The tunable microphone can also include electrically conductive traces affixed to the backplane and in contact with the piezoelectric nanostructures. The electrically conductive traces can collect the electrical signals from the piezoelectric nanostructures and transmit them to the conductive electrical bus. The tunable microphone can also include a band affixed to the backplane. The band can be positioned about the head of a user to maintain the backplane in contact with the user's head.

In one embodiment the tunable contact microphone can be a noise cancelling microphone. In this case, the tunable microphone includes an ambient microphone and a noise dampener affixed between the tuned contact microphone and the ambient microphone. A differential amplifier is connected between the impedance matching junction field effect transistor and the voice input. A second impedance matching junction field effect transistor is connected between the ambient microphone and the differential amplifier.

In one embodiment, the backplane can include an ear piece clip used in securing the ear piece to the user. The piezoelectric nanostructures are formed of piezoelectric materials doped onto nanowires and the nanowires are wrapped about the ear piece clip. The clip rests against the user's head and picks up the vibrations when the user speaks.

In one embodiment, the backplane can include an ear bud. As with the ear clip, the piezoelectric nanostructures are formed of piezoelectric materials doped onto nanowires and the nanowires are formed within the ear bud. When the ear bud is placed within the ear, it can pick up vibrations from within the ear canal when the user speaks.

In one embodiment, the piezoelectric doped nanowires are affixed onto the edge of a cell phone, which serves as the backplane. When speaking, a user places the edge of the phone to their head and the nanowires pick up the vibrations. The signals from the nanowires are fed to the voice input of the phone.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DESCRIPTION OF THE INVENTION

Figure 1:
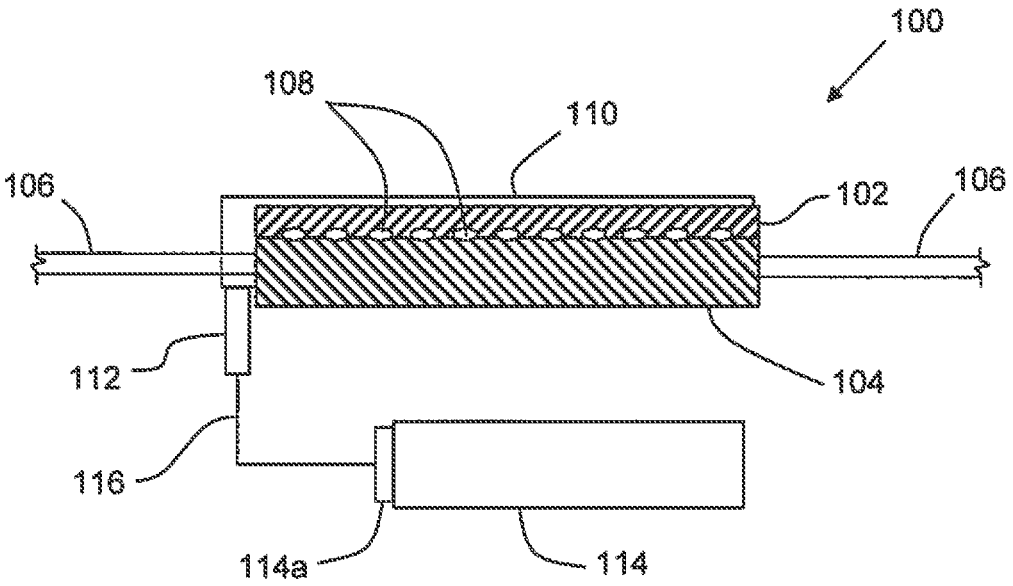
FIG. 1 illustrates a schematic cross-sectional view of a tunable contact microphone.

Referring now to FIG. 1, there is shown a schematic cross-sectional view of a tunable contact microphone 100. Microphone 100 is constructed from piezoelectric nanostructures 102 grown on tuned resonant backplane 104. As is known in the art, piezoelectric nanostructures 102 can consist of nanometer size piezoelectric materials or nanotubes, microfibers, nanowires or carbon nanotubes (CNT) doped with piezoelectric materials. Piezoelectric nanostructures 102 can have a diameter of about 2 to 100 nanometers.

Backplane 104 serves as a flexible substrate for piezoelectric nanostructures 102. Backplane 104 is designed to vibrate at fundamental harmonic or sub-harmonic frequencies from 10 Hz to 20 KHz, corresponding to vibration frequencies of the human cranium. Backplane 104 can be affixed to band 106 to facilitate attachment of backplane 104 and piezoelectric nanostructures 102 to a position on a person, which will vibrate when the person speaks. Suitable locations for attachment to a person can include, but are not limited to, the forehead, behind the ear, or on the throat. The forehead is the preferred location.

When so attached to a person, backplane 104, being tuned to the vibration frequencies of the human cranium, vibrates as the person speaks. As piezoelectric nanostructures 102 vibrate with backplane 104, they generate electrical signals, or voice signals. A plurality of conductive electrical traces 108 on backplane 104 terminate at, and transport the voice signals to, conductive electrical bus 110 positioned at one end of backplane 104. For clarity of illustration in FIG. 1, only two of electrical traces 108 are identified and bus 110 is shown at a distal end of backplane 104.

Bus 110 supplies the voice signals to junction field effect transistor (JFET) 112. JFET 112 matches the impedance of piezoelectric nanostructures 102 to that of communications system 114. The voice signal from JFET 112 is fed to voice input 114*a* of system 114 via electrical conductor 116. JFET 112 serves to greatly lessen attenuation of the voice signals.

Figure 2:
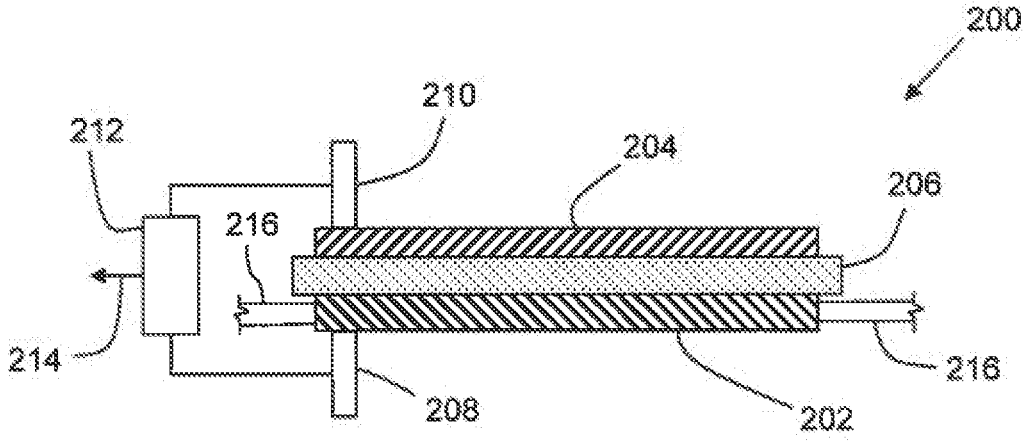
FIG. 2 illustrates a schematic cross-sectional view of a noise canceling tunable contact microphone.

Referring now to FIG. 2, there is shown a schematic cross-sectional view of noise canceling microphone 200. Noise canceling microphone 200 is constructed using contact microphone 202 and ambient microphone 204. Ambient microphone 204 can be any suitable microphone which will pick up background noise in the vicinity of contact microphone 202. Contact microphone 202 is constructed in the manner of tunable contact microphone 100 of FIG. 1.

Ambient microphone 204 is isolated from tunable contact microphone 202 by noise dampener 206 inserted between tunable contact microphone 202 and ambient microphone 204. Noise dampener 206 can be fabricated of a high-density material such as high-density vinyl or lead impregnated vinyl. In this configuration, tunable contact microphone 202 picks up voice signals, while ambient microphone 204 picks up background noise signals, but no voice signals.

The voice signals from contact microphone 202 are fed to voice impedance matcher 208 and noise signals from ambient microphone 204 are fed to noise impedance matcher 210. Impedance matchers, 208, 210 serve to eliminate the impedance mismatch between respective microphones 202, 204 and differential amplifier 212. Differential amplifier 212 subtracts the noise signal from ambient microphone 204 from the voice signal from contact microphone 202. The result is a voice signal with little or no background noise. The resulting signal can be fed (indicated by arrow 214) into the voice input of a communications system. As in the case of microphone 100, strap or band 216 facilitates attachment of noise canceling microphone 200 to a person with contact microphone 202 in contact with the person.

Figure 3:
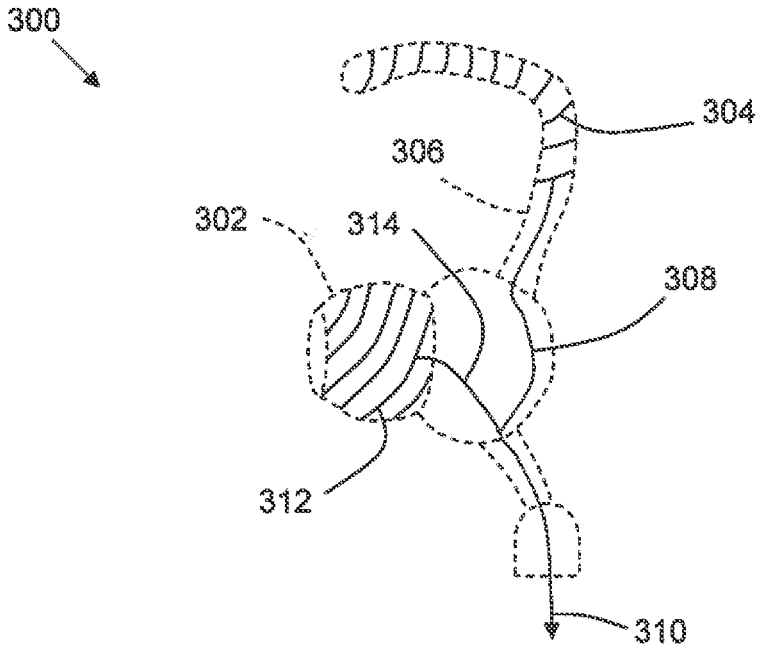
FIG. 3 illustrates a schematic view of a tunable contact microphone incorporated into an earbud.

Referring now to FIG. 3, there is shown a schematic view of tunable contact microphone 300 incorporated with earbud 302, such as can be used with a cell phone. Piezoelectric nanowires 304 are fabricated with clip 306, which holds earbud 302 to a person's ear. (For clarity of illustration, earbud 302 and clip 306 are shown in phantom in FIG. 3.) Clip 306 will be in contact with the person's head either in front or behind the ear. The skull vibrates when the person speaks, and the vibration stimulates nanowires 304. As in the case of contact microphone 100 of FIG. 1, the electrical signals from piezoelectric nanowires 304 can be processed and transmitted via electrical conductor 308 to a voice input of a communications system, such as a cell phone, as illustrated by arrow 310.

Figure 4:
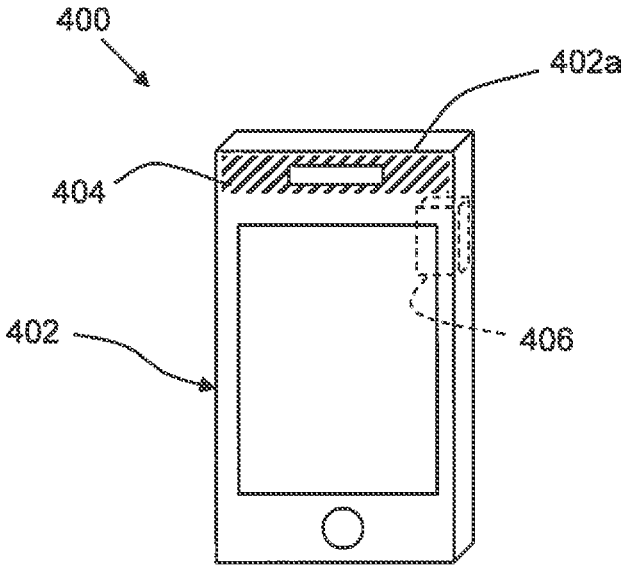
FIG. 4 illustrates a schematic view of a tunable contact microphone incorporated into a cell phone.

Referring now to FIG. 4, there is a schematic view of cell phone contact microphone 400 incorporated into cell phone 402. Piezoelectric nanowires 404 can be molded along top edge 402*a* of cell phone 402. When a person places cell phone 402 to their head, edge 402*a* contacts the person's head. When the person talks, the vibration of their head stimulates piezoelectric nanowires 404 which generate electrical signals. The signals are processed and transmitted to voice input 406 (shown in phantom in FIG. 4) within cell phone 402. The use of cell phone contact microphone 400 is extremely advantageous in noisy areas where a traditional cell phone microphone can pick up background noise.

What has thus been described is a tunable contact microphone (100, 200, 300 and 400) fabricated from nanometer size piezoelectric materials (102). The piezoelectric nanostructures are deposited on a flexible substrate or tuned resonant backplane (104). The backplane can be designed to vibrate at fundamental harmonic or sub-harmonic frequencies from 10 Hz to 20 KHz, corresponding to vibration frequencies of the human cranium.

The backplane can be attached to a band (106) or other material that will facilitate the attachment to the forehead, behind the ear or throat, with a preferred location being the forehead. When a person speaks, the backplane vibrates causing the nanostructures to generate electricity. The electrical signals are sent to an impedance matching preamplifier. The signal can then be sent to a communications system or fed into the microphone input of a communication system.

By being tuned to the vibration frequencies of the human cranium, contact microphone 100 provides a significant improvement in signal to noise, resulting in a crisper voice signal. Noise cancelling contact microphone 200 can further improve the voice signal. Contact microphones 300 and 400 provide compatibility with respective ear bud and cell phone use.

Obviously, many modifications and variations of the present invention may become apparent in light of the above teachings. For example, piezoelectric nanostructures 102 can be random lengths or can be grown to have the same lengths. Also, backplane 104 can be electrically conductive, negating the need for conductive traces 108. In this instance, backplane 104 transports the voice signals directly to conductive electrical bus 110.

In another modification, nanowires 312 (FIG. 3) can be embedded into the soft material of earbud 302. When a person speaks, sound waves travel in the ear canal and the vibrations can stimulate nanowires 312. The electrical signals from nanowires 312 can be carried to electrical conductor 308 via wire 314.

It will be understood that many additional changes in details, materials, steps, and arrangements of parts which have been described herein and illustrated in order to explain the nature of the invention, may be made by those skilled in the art within the principle and scope of the invention as expressed in the appended claims.

What is claimed is:

1. A tunable contact microphone, comprising:

a flexible backplane having resonant frequencies corresponding to human cranium vibration frequencies;

piezoelectric nanostructures affixed on said backplane, wherein electrical signals are generated by said piezoelectric nanostructures in response to resonance of said backplane;

a conductive electrical bus connected to said piezoelectric nanostructures, said electrical signals being collected by said conductive electrical bus; and an impedance matching junction field effect transistor connected between said conductive electrical bus and a voice input of a communications system.

2. The tunable contact microphone of claim 1, wherein said piezoelectric nanostructures comprise piezoelectric materials doped onto at least one of nanotubes, microfibers, nanowires and carbon nanotubes.

3. The tunable contact microphone of claim 1, further comprising electrically conductive traces affixed to said backplane, said electrically conductive traces connected between said piezoelectric nanostructures and said conductive electrical bus.

4. The tunable contact microphone of claim 3, wherein said piezoelectric nanostructures comprise piezoelectric materials doped onto at least one of nanotubes, microfibers, nanowires and carbon nanotubes.

5. The tunable contact microphone of claim 3, wherein said piezoelectric nanostructures comprise nanometer size piezoelectric materials grown on said backplane.

6. The tunable contact microphone of claim 5, wherein said piezoelectric nanostructures are of varying lengths.

7. The tunable contact microphone of claim 1, wherein said piezoelectric nanostructures comprise nanometer size piezoelectric materials grown on said backplane.

8. The tunable contact microphone of claim 7, wherein said piezoelectric nanostructures are of varying lengths.

9. The tunable contact microphone of claim 1, further comprising a band affixed to said backplane, said band adapted to be positioned about a head of a user and maintain said backplane in contact with said head of said user.

10. The tunable contact microphone of claim 1, further comprising:

an ambient microphone;

a noise dampener affixed between said tunable contact microphone and said ambient microphone;

a differential amplifier connected between said impedance matching junction field effect transistor and said voice input; and a second impedance matching junction field effect transistor connected between said ambient microphone and said differential amplifier.

11. The tunable contact microphone of claim 10, wherein said piezoelectric nanostructures comprise piezoelectric materials doped onto at least one of nanotubes, microfibers, nanowires and carbon nanotubes.

12. The tunable contact microphone of claim 11, further comprising electrically conductive traces affixed to said backplane, said electrically conductive traces connected between said piezoelectric nanostructures and said conductive electrical bus.

13. The tunable contact microphone of claim 10, wherein said piezoelectric nanostructures comprise nanometer size piezoelectric materials grown on said backplane.

14. The tunable contact microphone of claim 13, wherein said piezoelectric nanostructures are of varying lengths.

15. The tunable contact microphone of claim 10, further comprising a band affixed to said backplane, said band adapted to be positioned about a head of a user and maintain said backplane in contact with said head of said user.

16. The tunable contact microphone of claim 1, wherein:

said backplane comprises an ear piece clip; and said piezoelectric nanostructures comprise piezoelectric materials doped onto nanowires.

17. The tunable contact microphone of claim 1, wherein:

said backplane comprises an earbud; and said piezoelectric nanostructures comprise piezoelectric materials doped onto nanowires.

18. The tunable contact microphone of claim 1, wherein:

said backplane comprises an edge of a cell phone; and said piezoelectric nanostructures comprise piezoelectric materials doped onto nanowire.

* * * * *